US007004415B2

(12) United States Patent
Ingram, III

(10) Patent No.: US 7,004,415 B2
(45) **Date of Patent: *Feb. 28, 2006**

(54) COMPACT CREEL

(75) Inventor: William O. Ingram, III, Cusseta, AL (US)

(73) Assignee: Interface, Inc., Atlanta, GA (US)

( * ) Notice: Subject to any disclaimer, the term of this patent is extended or adjusted under 35 U.S.C. 154(b) by 64 days.

This patent is subject to a terminal disclaimer.

(21) Appl. No.: 10/642,003

(22) Filed: Aug. 15, 2003

(65) Prior Publication Data

US 2004/0050995 A1 Mar. 18, 2004

Related U.S. Application Data

(63) Continuation of application No. 09/830,733, filed as application No. PCT/US99/25985 on Nov. 4, 1999, now Pat. No. 6,634,585.

(60) Provisional application No. 60/134,589, filed on May 17, 1999, provisional application No. 60/107,495, filed on Nov. 6, 1998, and provisional application No. 60/107,494, filed on Nov. 6, 1998.

(51) Int. Cl.
*B65H 49/02* (2006.01)
*B65H 57/00* (2006.01)

(52) U.S. Cl. ..... 242/131.1; 242/157 R; 242/594.6

(58) Field of Classification Search ..... 242/131, 242/131.1, 157 R, 129.62, 129.72, 594.4, 242/594.5, 594.6

See application file for complete search history.

(56) References Cited

U.S. PATENT DOCUMENTS

| | | | | |
|---|---|---|---|---|
| 3,575,359 A | | 4/1971 | Furst | 242/131 |
| 3,664,602 A | | 5/1972 | Renzi | 242/131 |
| 3,875,883 A | | 4/1975 | Eberwein et al. | 242/131.1 X |
| 4,065,073 A | | 12/1977 | Rohner | 242/131 |
| 4,324,755 A | | 4/1982 | Bommer | 264/312 |
| 4,498,644 A | | 2/1985 | Kupper et al. | 242/131.1 |
| 4,880,184 A | | 11/1989 | Crow | |
| 5,024,393 A | | 6/1991 | Gutschmit | 242/131 |
| 5,347,942 A | * | 9/1994 | Thomas | 112/302 |
| 5,531,392 A | | 7/1996 | Weiner | 242/131 |
| 5,613,643 A | | 3/1997 | Weiner | 242/131 |
| 5,624,082 A | | 4/1997 | Ligon | |
| 5,806,773 A | | 9/1998 | Kremer et al. | |

FOREIGN PATENT DOCUMENTS

| | | |
|---|---|---|
| JP | 51-13958 | 7/1993 |
| JP | 07-37704 | 2/1995 |

* cited by examiner

*Primary Examiner*—Eileen D. Lillis
*Assistant Examiner*—Evan H Langdon
(74) *Attorney, Agent, or Firm*—Kilpatrick Stockton, LLP; John S. Pratt; Kristin J. Doyle

(57) ABSTRACT

A highly mobile, compact creel that utilizes frames for holding yarn packages (or bobbins) for feeding yarn to a tufting machine. Each frame includes holders affixed to the frame for holding yarn packages facing front and back, a header attachable to the frame for directing yarn from the yarn packages to the tufting machine, and anti-static flexible tubing for leading yarn from the holders to the header. The header provides for aligning all the yarn ends in the same plane to join them to ends already threaded into the tufting machine. An optional frame overlay upright having a ring affixed thereto and strands threaded through the ring prevents yarn from upper yarn packages from falling onto tubes holding lower yarn packages causing yarn entanglement.

16 Claims, 6 Drawing Sheets

COMPACT CREEL

RELATED APPLICATIONS

This application is a continuation and claims priority to U.S. patent application Ser. No. 09/830,733 filed Jul. 23, 2001 now U.S. Pat. No. 6,634,585, PCT/US99/25985 filed Nov. 4, 1999 published as WO 00/27532, 60/107,494 filed Nov. 6, 1998, entitled, "Compressed Portable Tufting Creel," U.S. Patent Application No. 60/107,495 filed Nov. 6, 1998, entitled, "Alignment Header for Burning-In Process," and U.S. Patent Application No. 60/134,589 filed May 17, 1999, entitled, "Compact Creel," all which are incorporated by reference herein.

FIELD OF THE INVENTION

This invention relates in general to the field of carpet production, and in particular, to carpet yarn creels.

BACKGROUND OF THE INVENTION

Carpet tufting machines are relatively compact devices. However, substantial space within a carpet production facility is required for the entire tufting process. In addition to the space occupied by a tufting machine (i.e. the tufter) itself, there must be roll-up or additional processing equipment, or both, positioned downstream from the tufter.

Substantial additional space is required to supply yarn to the tufter. Yarn is typically supplied directly to the tufter by one of two methods. It may come from a "creel," which is a rack holding large bobbins or packages of yarn that spool off of the bobbins and into the tufter. Conventional creels occupy substantial floor space "upstream" from the tufter because of the size of the packages or bobbins of yarn and the space needed to hold them so that the many separate strands of yarn can be pulled off the bobbins and fed into the tufting machine. The floor space required by a standard warper and creel is on the order of 2,000 square feet.

Alternatively, yarn can be fed to the tufting machine from a "beam," a large horizontal mandrel onto which multiple strands of yarn of the needed colors are wound in advance. The yarn strands are then unwound simultaneously from the beam into the tufter. While beams typically require substantially less space immediately in front of the tufter than conventional creels, substantial space is needed, and significant work is required to prepare the beam, because in order to position yarn on a beam, bobbins or yarn packages must be positioned on creels to "feed" the beam, much as the yarn packages would be positioned to feed a tufter directly.

A significant challenge to carpet manufacturers is to reduce the amount of yarn waste occurring in the manufacturing of carpet. Wasted yarn can occur in several stages during the manufacturing process. For example, there can be yarn waste due to tufting beam waste, production beam waste and/or warping beam waste. A cause of waste is the inability to effectively determine the amount of yarn that is needed for a particular piece of carpet. As yarn is fed into a tufting machine it may be realized that yarn length for one color in a pattern is too short while yarn length for another color in the pattern is too long, resulting in wasted yarn. Large bobbins of yarn or beams of yarn compound the problem due to the sheer size of the yarn contained. A compact creel with smaller yarn packages reduces waste in the manufacturing process. Another significant problem is carpet overrun overage.

Therefore, a need exists for a compact creel that occupies less space on the manufacturing floor and reduces yarn waste in the manufacturing process, while enabling the same quantities of carpet production as that produced from a conventional creel.

SUMMARY OF THE INVENTION

This invention is a highly mobile, compact creel that utilizes frames for holding yarn packages (or bobbins), where the packages may be in the form supplied by the yarn supplier (typical sizes are initially about 6 inches or about 10–11 inches in diameter). Each frame can hold yarn packages facing front and back. Each creel frame can hold, for instance, about 416 yarn packages, for a total of approximately 832 yarn packages, so that the two sides of the frames together hold sufficient yarn ends for a typical carpet tufting machine. Other numbers of packages can also be accommodated, and multiple frames can be used to feed a single tufting machine.

A header having adjustable bars and slots for the yarn mates and affixes to the frame. This header provides for aligning all of the yarn ends in the same plane in order to join them to ends already threaded into the tufting machine.

In operation, yarn spools off of the end of the yarn package, through an eyelet (or yarn eye), through a rigid tube affixed to the frame (and inside the hollow yarn package), and through a flexible tube leading to the top of the frame, and into the header. The flexible tube typically passes through the rigid tube on which the package rests and a yarn eye at the end of the rigid tube can be formed on the end of the flexible tube. The floor space required for two 16 foot frames of the compact creel of this invention is on the order of 160 square feet.

A yarn reclamation procedure of this invention strips the yarn packages without unloading the yarn packages from the creel. The ends of the yarn tie from head to tail. The portable creel is placed in front of a backwinder head, and skinner yarn pieces wind onto one package or a few packages.

Objects of this invention include:

To provide a compact creel that reduces yarn waste in the tufting, production and warping processes.

To provide an alternative use for warping beam yarn, other than overrun carpet or beam waste.

To provide a compact creel that increases the quality of the finished product by reducing slack ends.

To provide yarn inventory reduction and decreased amounts of material handling.

To provide a compact creel that requires less floor space.

To provide an efficient reclamation procedure.

To provide a compact creel that reduces the labor required in the warping process.

To provide simplified scheduling and increased plant through-put time.

To provide all the same features for sample production and carpet development.

As the following description and accompanying drawings make clear, these and other objects are achieved by this invention.

DETAILED DESCRIPTION

Figure 1:
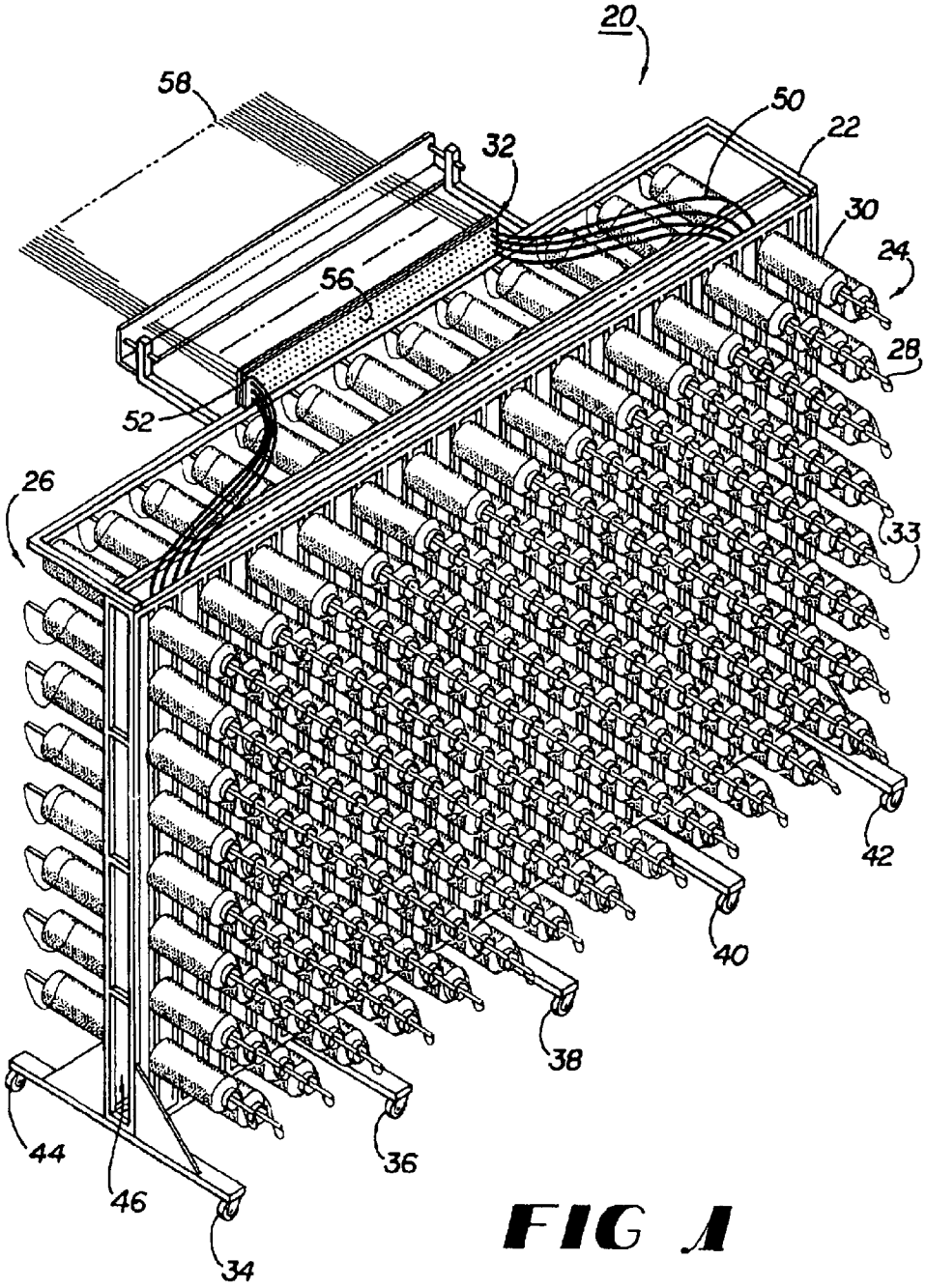
FIG. 1 is a perspective view of both sides of a compact creel of this invention including a frame, a header, yarn packages on hollow supports and flexible tubing.

FIG. 1 is a perspective view of a compact creel 20 of this invention. The compact creel 20 includes a frame 22 having a front portion 24 and a rear portion 26, multiple hollow supports 28 attached to the frame 22 for holding yarn packages 30, and an attachable header 32. Preferably, the frame 22 can hold about 832 yarn packages 30 with approximately 416 yarn packages 30 on each of the front 24 and rear 26 portions of a sixteen foot frame 22. Generally, the yarn packages 30 have a diameter of about seven inches and are about twelve inches long. Preferably, the overall footprint of the compact creel 20 is on the order of 160 square feet or less. A variety of yarn packages 30 can be used with the compact creel 20 including yarn packages 30 containing yarn 33, that is for instance, tightly twisted, loosely twisted and air entangled. Casters 34, 36, 38, 40, 42 and 44 placed on the bottom of the frame 22 provide for ease of movement of the compact creel 20.

As illustrated in FIG. 1, the yarn packages 30 of the creel 20 are arranged in compact staggered rows. The hollow supports 28 holding the yarn packages 30 are closely spaced, for instance about one inch apart, so that side-to-side and above-and-below positions of yarn packages 30 are close. This configuration is an improvement over the existing arrangements that requires large bobbins of yarn occupying substantial space before feeding into a tufting machine, and a labor intensive set up process. The compactness of the yarn packages 30, the large quantity of yarn packages 30 fitting on a creel 20 and reductions in set-up and labor costs provide for a more efficient system for delivering yarn to a tufting machine.

Preferably, the front portion 24 and the rear portion 26 of the frame 12 define a passageway 46. Flexible anti-static tubing 50 affixes to the header 32 at one end 52 of the flexible tubing 50 and travels through the passageway 46 with the other end 54 (not shown) of the flexible tubing 50 positioned through the hollow support 28. Yarn 33 feeds through the flexible tubing 50 to the header 32, and through the slots 56 in the header to the tufting machine (represented by dash line 58). The arrangement of the header 32 and slots 56 ensures that yarns feeding into the tufting machine 58 lie in the same plane.

Figure 2:
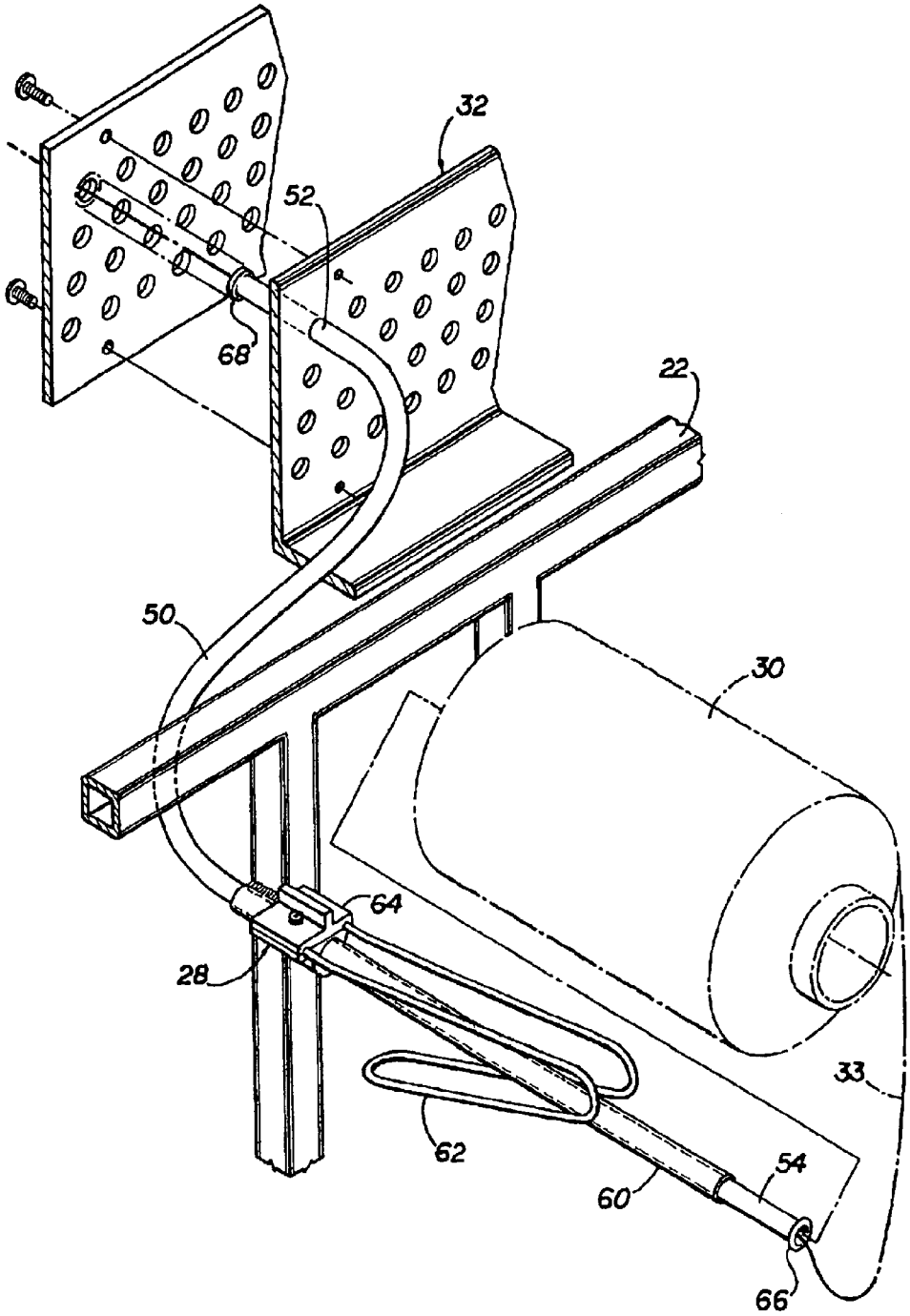
FIG. 2 is an exploded perspective view of a portion of the compact creel of FIG. 1, including a hollow support for a yarn package shown in broken lines and a support, a flexible yarn tube and a portion of the header.

FIG. 2 shows a perspective view of the hollow support 28. The hollow support 28 includes a tube 60, a retainer spring clip 62, and a connector 64. The hollow support 28 can be configured, for instance, as a length of round or square pipe or metal tube. Preferably, the tube 60 is welded to the frame 22, and the connector 64 having the retainer spring clip 62 attaches to the tube 60. The connector 64 can attach to the tube by a variety of methods including, for instance, screwing, welding, and gluing. The tube 60 is hollow, allowing the flexible tubing 50 to be positioned therein. The yarn package 30 is removably placed on the hollow support 28. An eyelet 66 formed by heat flaring the end 54 of the flexible tubing 50.

During setup of the creel 20, an end of a strand of yarn 33 is unwrapped from the yarn package 30. The yarn 33 is blown through the flexible tubing 50 up to the header 32. As yarn 33 spins off the yarn package 50, the eyelet 66 serves to allow continuous feeding from the yarn package 30 through the flexible tubing 50, aids the threading process and helps avoid wear as the yarn 33 is pulled through. Alternatively, a ceramic or ceramic-coated yarn eye may be attached to the end of the tube 60. As shown in FIG. 2, the flexible tubing 50 snakes behind the frame 22 and traverses up to the header 32. The other end 52 of the flexible tubing 50 that affixes to the header 32 can also be heat flared ensuring the flexible tubing 50 remains in place on the header 32 by the heat flared end 68. Preferably, yarn 33 removal from the yarn packages 30 onto the tufting machine 58 is relatively slow, with little wear on the heat flared end of the flexible tubing 50.

Figure 3:
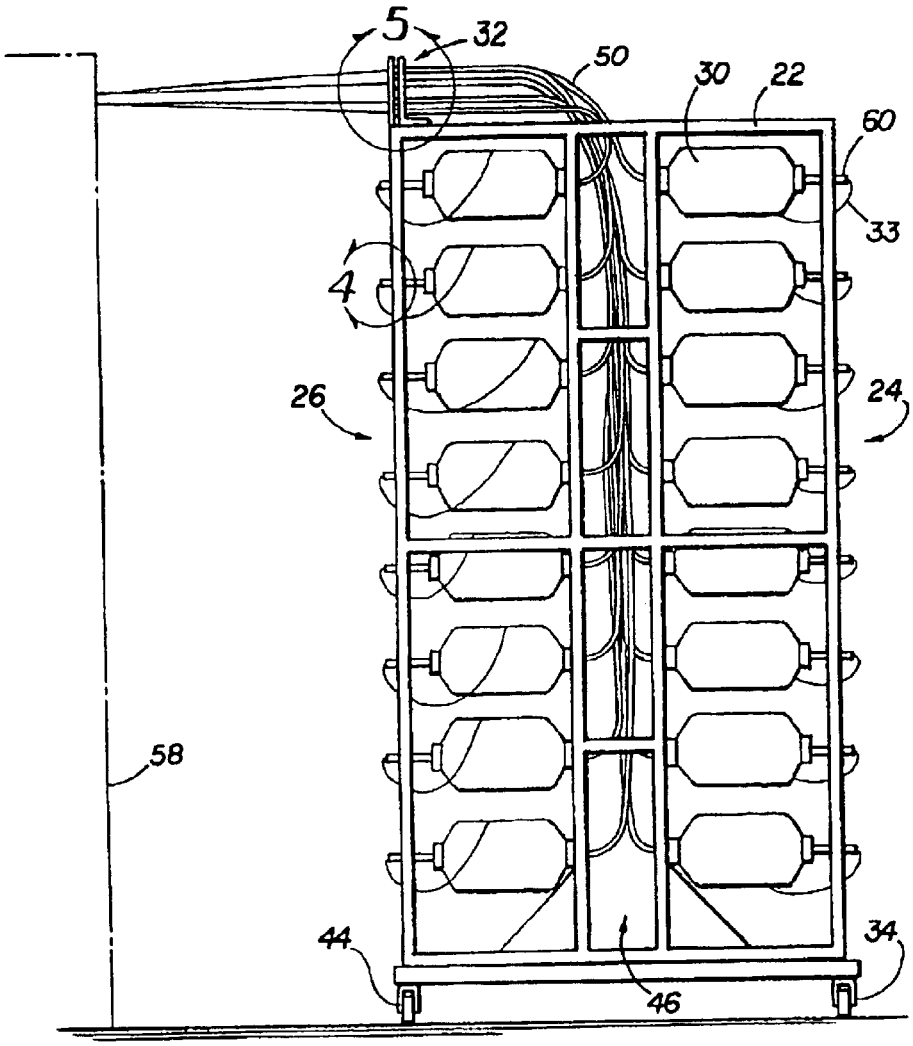
FIG. 3 is a side elevation view of a front and rear portion of the creel of FIG. 1.

FIG. 3 is a side elevation view of the front 24 and rear 26 portion of the frame 22 of the creel 20 of FIG. 1. As shown in FIG. 3, the flexible tubing 50 travels from the hollow support 28 up the passageway 46 of the frame 22 to the header 32. As shown, both portions 24, 26 of the frame 22 contain a plurality of yarn packages 30. Yarn 33 inside the flexible tubing 50 travels through the passageway 46 to the header 32. Yarn 33 exiting the header 32 aligns to enter the tufting machine 58.

Figure 4:
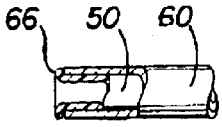
FIG. 4 is a side view, partially in section of the end of a package support tube and flexible tubing.

FIG. 4 is an enlarged side elevation view of the end tube 60. Tube 60 contains the flexible tubing 50 with an eyelet 66 at the end 54 of the flexible tubing. The eyelet 66 serves to hold the flexible tubing 50 in place within the tube 60.

Figure 5:
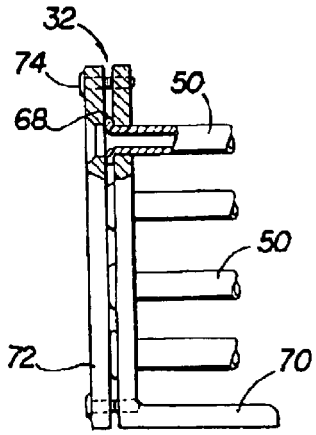
FIG. 5 is an end view, partially in section of the header.

FIG. 5 is an enlarged side view of the header 32. The header 32 includes a first plate 70 and a second plate 72. The flexible tubing 50 threads through the first plate 70. The heat flared end 68 of the flexible tube 50 serves to keep the flexible tubing 50 from coming out of the first plate 72. The heat flared end 68 of the flexible tubing 50 abuts the second plate 72. The second plate 72 attaches to the first plate 70 by any connecting methods such as, for example, bolts 74.

Figure 6:
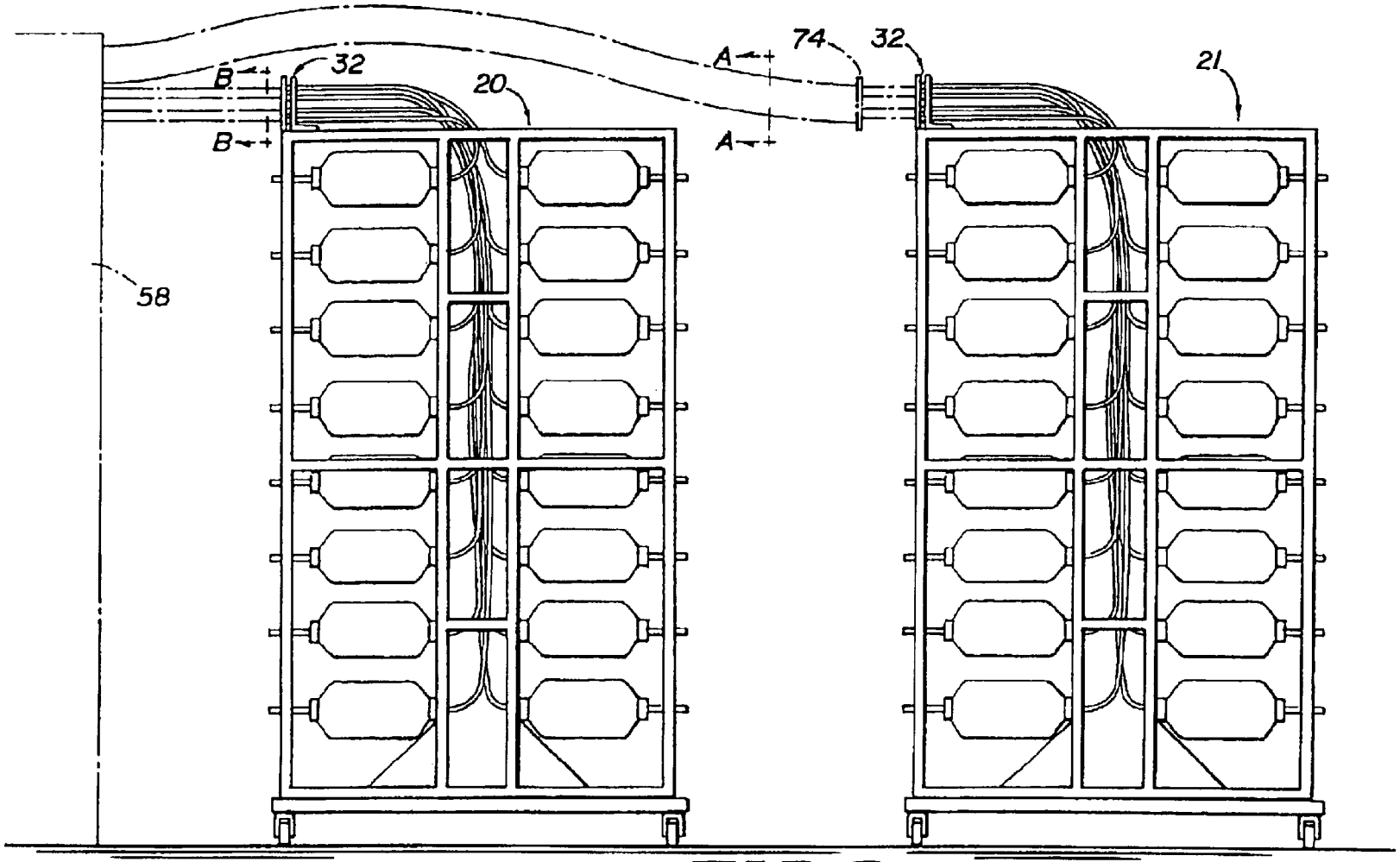
FIG. 6 is a side elevation view of two of the creels of FIG. 1 showing the path yarn takes to enter a tufting machine with yarn from one creel traveling over the other creel.

FIG. 6 is a side elevation view of two creels 20 and 21 placed one in front of the other. Because of the portable nature of the compact creel 20, more than one compact creel 20, 21 can be used at the same time with a tufting machine 58. After one compact creel 20 is set up and connected to the tufting machine 58, the second compact creel 21 can be placed into position and attached to the tufting machine 58. The first creel 20 is positioned closest to the tufting machine 58. The second creel 21 placed behind the first creel 20 has all the elements of the first creel 20 with an additional feature. The second creel 21 includes a yarn guide 74 for directing the yarn 33 exiting the header 32 over the first creel 20 and into the tufting machine 58. The yarn guide 74 creates an angled path for the yarn 33 to traverse, as illustrated by directional arrow A-A to insure that the yarn 30 does not travel a path that would interfere with the operation of the first creel 20. The yarn 33 exiting the first creel 20 travels path B—B which is a separate path from path A—A.

In an alternative embodiment, the yarn guide 74 includes a yarn slide that is placed across the top of the compact creel 21. The yarn guide can include a bar affixed to and positioned above an upper portion of the frame 22. So that yarn coming from the header 32 of the second compact creel 21 into the tufting machine 58 is not damaged or broken when the first compact creel 20 slides into position, the yarn slide acts as a "roof" that allows the yarn to slide along an upper portion of the yarn slide as the first creel 20 is placed in proper position.

Figure 7:
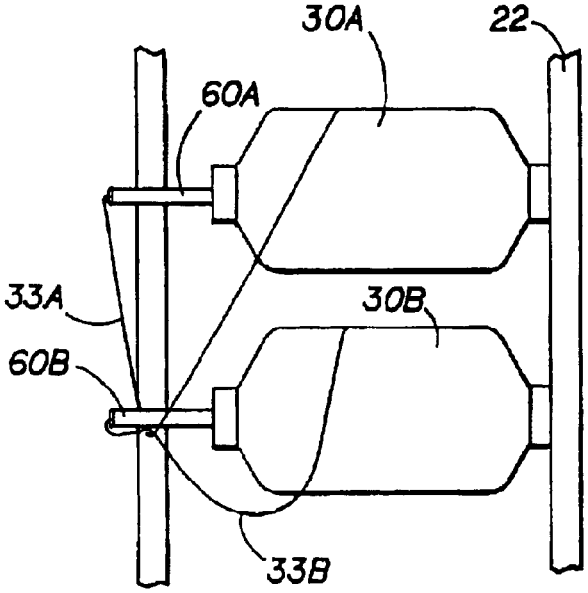
FIG. 7 is a side elevation view of two yarn packages illustrating the problem of yarn falling from one yarn package to another yarn package and becoming entangled therein.

FIG. 7 is a schematic side elevation view of two yarn packages 30A and 30B illustrating how yarn 33A falls from one yarn package 30A to another yarn package 30B and becomes entangled. The hollow support 28 that supports the yarn packages 30 (including 30A and 30B) allows the yarn to spool off at a variety of speeds including high speeds of about 800 rpm. Yarn packages 30 having different tensions of yarn 33 on the yarn packages 30 such as loosely twisted or tightly twisted yarn 33 can spool off the yarn package 30 at different rates. Yarn packages 30 containing different types of yarn 33 placed above each other can cause the yarn from one package to become entangled with another package. FIG. 7 shows this situation where the yarn 33A from the upper yarn package 30A has fallen onto the tube 60B of the lower yarn package 30B. This problem causes the yarn 33A to jam, requiring stopping the operation of the creel to untangle the yarn packages 30A and 30B which can negatively affect productivity.

Figure 8:
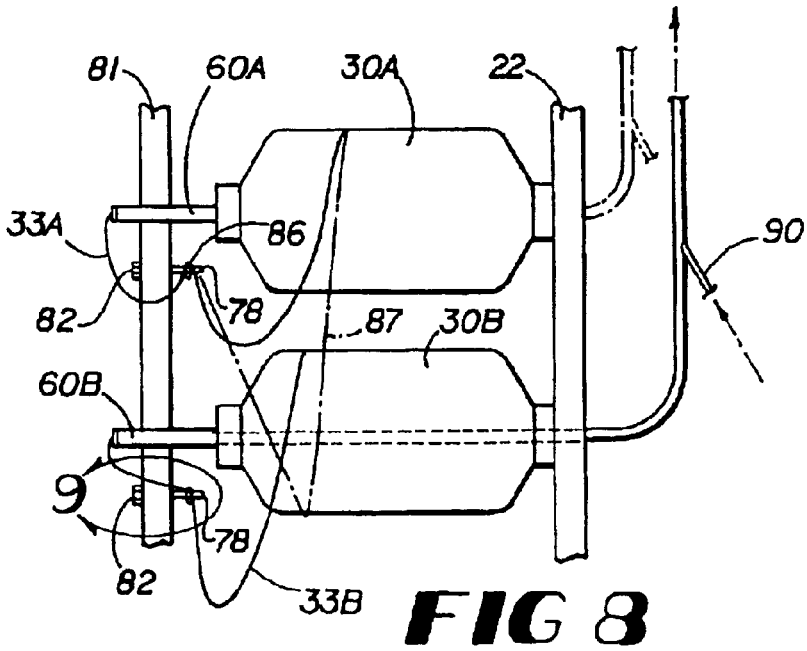
FIG. 8 is a side elevation view of two yarn packages and an air shunt in the flexible tubing for blowing air through the flexible tubing and a ring having lines for capturing any slack yarn to avoid the problem of the yarn becoming entangled as shown in FIG. 7.

FIG. 8 shows a method for addressing the yarn entanglement problem including a ring having a line for capturing any slack yarn to avoid the problem of the yarn becoming entangled as shown in FIG. 7. The ring 78 having a threaded shank 80 (shown in FIG. 9) received in an overlay upright 81 and held in place by a nut 82. A line or strand 84, such as, for instance, fishing wire or monofilament line, loops through the ring 78 and extends across the overlay upright 81 and attaches at the opposite end of the overlay upright 81 (shown in FIG. 10). The front portion 24 and rear portion 26 of the overlay upright 81 can contain such strands 84. The placement of the ring 78 and strand 84 avoids the problem of yarn 33A entanglement by supporting any loose yarn on the strand as shown at 86. Further, even if yarn 33A is very loose and falls down to the lower yarn package 30B, the yarn follows the likely path shown at 87 and does not become entangled in the tube 60B of the lower yarn package 30B.

FIG. 8 also illustrates use of a shunt for blowing air through the flexible tubing 50. Shunt 90 attaches to the flexible tubing 50 providing an alternative location for air entry to blow the yarn 33 through the flexible tubing 50. In another alternative embodiment, multiple shunts can be fed by a single manifold so that air can simultaneously be blow through tubes 50.

Figure 9:
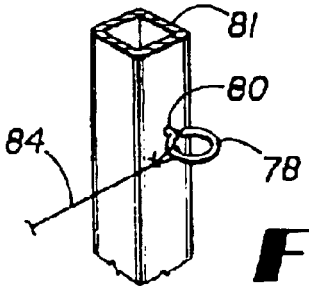
FIG. 9 is a perspective view of the ring, threaded shank and line affixed to the overlay upright taken at oval "9" in FIG. 8.

FIG. 9 is a perspective view of the ring 78, shank 80 and strand 84 taken at oval "9" in FIG. 8. The wire 84 extends across the front and rear portions 22, 24 of the frame 22 such that yarn 33A from an upper yarn package 30A does not become entangled with yarn 33B from a lower yarn package 30B.

Figure 10:
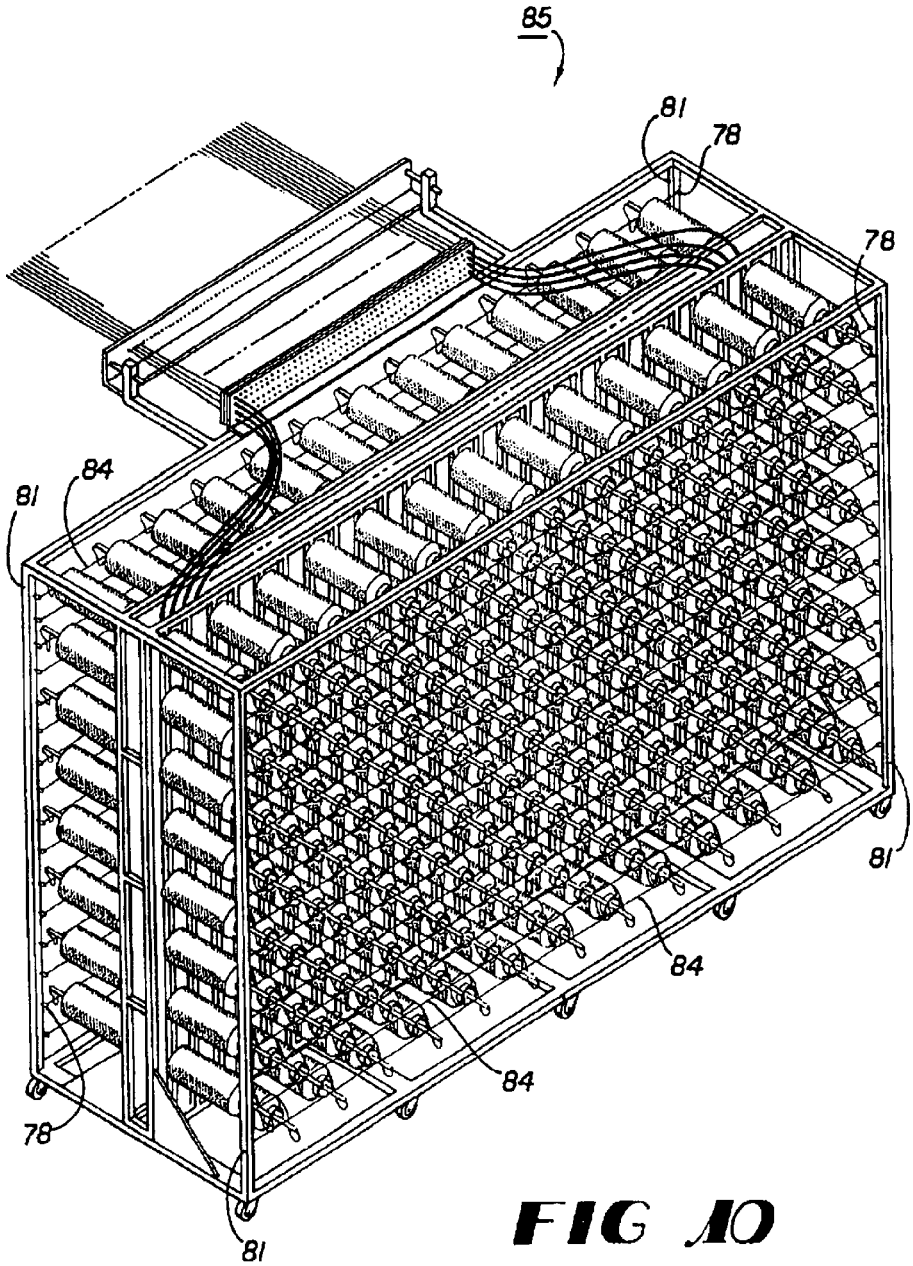
FIG. 10 is a perspective view of the creel having the overlay upright, ring, shank and lines of FIG. 9 extending across the front and rear portions of the frame.

FIG. 10 is a perspective view of the front portion 24 of a compact creel 85 having the strands 84 of FIG. 9 extending across overlay uprights 81. The overlay uprights 81 contain a series of rings 78 for attaching strands 84 between each horizontal row of yarn packages 30 to prevent yarn 33A from an upper yarn package 30A from inadvertently wrapping around a tube 60B of a lower yarn package 30B entangling the yarn 33A.

Yarn reclamation can occur by stripping the yarn 33 from the yarn packages 30 without unloading the yarn packages 30 from the creel 20, 21 and 85. The ends of the yarn 33 in adjacent packages 30 are tied from head to tail. The portable creel 20, 21 and 85 is placed in front of a backwinder head, and skinner yarn pieces wind onto one package or a few packages.

An advantage of this invention is that it provides a compact creel that substantially reduces wasted yarn while making a comparable sized carpet.

Yet another advantage of this invention is that it provides for improved quality by reducing yarn slack ends.

Still another advantage of this invention is that it improves plant through-put time because the warping process is eliminated for smaller jobs.

Another advantage of this invention is that it increases output because it provides for placing yarns of different thickness having different lengths on yarn packages directly next to each other on the compact creel. This also increases carpet design flexibility.

Some other advantages of the compressed, portable, tufting creel include:

Tufting setup time reduction
Carpet overrun overage reduction and control
Usable plant floor space increases
Yarn warehouse inventory reduction
Improved skinner yarn reclamation
Simplified scheduling of plant personnel
Material handling labor reduction
Redirection of non-value added labor to value added labor
Enhanced sample production While certain embodiments of this invention have been described above, these descriptions are given for purposes of illustration and explanation. Variations, changes, modifications and departures from the systems and methods disclosed above may be adopted without departure from the scope or spirit of this invention.

I claim:

1. A compact creel comprising:

a) a frame;

b) a plurality of holders affixed to the frame for holding yarn packages; and c) a header having a length and mountable on the frame for directing yarn from the yarn packages to a machine for using the yarn to make a textile product, wherein the header comprises a first plate having a plurality of holes and a second plate having a plurality of holes that align with the plurality of holes in the first plate, wherein the aligned holes of the first and second plates form a plurality of organized positions along the length of the header, each position capable of receiving yarn from a pre-determined yarn package and organizing the yarn relative to the machine.

2. The compact creel of claim 1, wherein the second plate is removably attached to the first plate.

3. A compact creel comprising:

a) a frame;

b) a plurality of holders affixed to the frame for holding yarn packages;

c) a header having a length and mountable on the frame for directing yarn from the yarn packages to a machine for using the yarn to make a textile product, wherein the header comprises a plurality of organized positions along its length, each position capable of receiving yarn from a pre-determined yarn package and organizing the yarn relative to the machine; and d) for at least some of the plurality of holders a flexible tube having two ends for guiding yarn from a holder to the header.

4. The compact creel of claim 3, wherein the header comprises at least one plate having a plurality of holes.

5. The compact creel of claim 3, wherein at least some of the plurality of holders comprise a hollow tube affixed to the frame.

6. The compact creel of claim 5, wherein at least some of the plurality of holders further comprise a retainer spring clip connected to the hollow tube for holding the yarn packages.

7. The compact creel of claim 3, wherein each of the at least some of the plurality of holders comprises a hollow tube affixed to the frame and one end of the flexible tube is held within one of the hollow tubes and the other end of the flexible tube is attached to the header.

8. The compact creel of claim 3, wherein the plurality of holders are affixed to both a front portion and a rear portion of the frame.

9. The compact creel of claim 8, further comprising a vertical passageway for receiving the flexible tube between the front portion and the rear portion of the frame.

10. The compact creel of claim 3, further comprising horizontal lines for preventing yarn from an upper yarn package from becoming entangled with another yarn package.

11. The compact creel of claim 3, further comprising a yarn guide for guiding yarn from the frame over at least one other frame into the machine.

12. A compact creel comprising:

a) a frame;

b) a plurality of holders affixed to the frame for holding yarn packages;

c) a header having a length and mountable on the frame for directing yarn from the yarn packages to a machine for using the yarn to make a textile product, wherein the header comprises a plurality of organized positions along its length, each position capable of receiving yarn from a pre-determined yarn package and organizing the yarn relative to the machine; and d) horizontal lines for preventing yarn from an upper yarn package from becoming entangled with another yarn package, wherein at least one of the horizontal lines comprises a monofilament.

13. A compact creel for yarn packages having a hollow core, the creel comprising:

a) at least one array of support tubes for holding yarn packages;

b) a plurality of lengths of flexible tubing positioned with one end of at least one length of flexible tubing within one support tube and the other end of the at least one length of flexible tubing positioned to direct yarn toward a machine for using the yarn to make a textile product; and c) alignment means mountable on the creel for aligning yarn with the machine.

14. The compact creel of claim 13, wherein the at least one array of support tubes comprises two arrays of support tubes positioned with a space therebetween.

15. The compact creel of claim 13, wherein the alignment means comprises at least one plate having a plurality of holes.

16. A method for providing yarn to a machine for using the yarn to make a textile product comprising:

a) providing a compact creel having a frame with a holder and a header attached to the frame, wherein a flexible tube is positioned between the holder and the header;

b) placing a yarn package containing yarn wound thereon onto the holder;

c) blowing air through the holder, thereby forcing an end of the yarn through the holder and the flexible tube and through the header, wherein the yarn exits the header; and d) pulling the yarn exiting from the header and connecting the yarn to yarn pieces coupled to the machine.

* * * * *